US010041492B2

(12) United States Patent
Naiki et al.

(10) Patent No.: US 10,041,492 B2
(45) Date of Patent: Aug. 7, 2018

(54) FLUID PUMP HAVING A RETURN PASSAGE PARALLEL TO A SUCTION PASSAGE

(71) Applicant: MIKUNI CORPORATION, Tokyo (JP)

(72) Inventors: Takehiko Naiki, Iwate (JP); Hiroyuki Oda, Iwate (JP); Yuya Kaiho, Iwate (JP)

(73) Assignee: MIKUNI CORPORATION, Tokyo (JP)

( * ) Notice: Subject to any disclaimer, the term of this patent is extended or adjusted under 35 U.S.C. 154(b) by 235 days.

(21) Appl. No.: 14/895,530

(22) PCT Filed: Jun. 3, 2014

(86) PCT No.: PCT/JP2014/064690
§ 371 (c)(1),
(2) Date: Dec. 3, 2015

(87) PCT Pub. No.: WO2014/196513
PCT Pub. Date: Dec. 11, 2014

(65) Prior Publication Data

US 2016/0123323 A1 May 5, 2016

(30) Foreign Application Priority Data

Jun. 4, 2013 (JP) ..... 2013-117488

(51) Int. Cl.
*F04C 14/24* (2006.01)
*F04C 15/06* (2006.01)
(Continued)

(52) U.S. Cl.
CPC ..... *F04C 14/24* (2013.01); *F01C 21/108* (2013.01); *F04C 2/102* (2013.01); *F04C 11/001* (2013.01);
(Continued)

(58) Field of Classification Search
CPC ..... F04C 14/26; F04C 15/06
See application file for complete search history.

(56) References Cited

U.S. PATENT DOCUMENTS 9,752,472 B2 * 9/2017 Zheng ..... F04C 14/26
2007/0243094 A1 * 10/2007 Fujita ..... F04C 15/062 418/259
2009/0041593 A1 * 2/2009 Yokoi ..... F04C 14/26 417/307

FOREIGN PATENT DOCUMENTS

DE 10 2009 015 990 7/2010
JP 63-149260 6/1988
(Continued)

OTHER PUBLICATIONS

International Search Report dated Sep. 9, 2014 in International (PCT) Application No. PCT/JP2014/064690.

*Primary Examiner* — Mary A Davis
(74) *Attorney, Agent, or Firm* — Wenderoth, Lind & Ponack, L.L.P.

(57) ABSTRACT

A fluid pump includes a housing, a rotary shaft, and pump units which are contained in the housing and sucks in, pressurizes, and discharges fluid with being rotationally driven by the rotary shaft. The housing has a suction passage conducting the fluid from a suction port to the pump unit, a discharge passage conducting the fluid from the pump unit to a discharge port, a return passage returning a portion of the fluid flowing through the discharge passage to an upstream side of the pump unit, and a control valve controlling a flow of the returned fluid. The return passage is formed so as to conduct the returned fluid in the same direction as a flow of a sucked fluid flowing through the suction passage to make the returned fluid flow together with the sucked fluid.

8 Claims, 12 Drawing Sheets

(51) Int. Cl.

| | |
|---|---|
| ***F04C 14/26*** | (2006.01) |
| ***F01C 21/10*** | (2006.01) |
| ***F04C 2/344*** | (2006.01) |
| ***F04C 11/00*** | (2006.01) |
| ***F04C 2/10*** | (2006.01) |

(52) U.S. Cl.
CPC ..... *F04C 14/26* (2013.01); *F04C 15/06* (2013.01); *F04C 2/344* (2013.01)

(56) References Cited

FOREIGN PATENT DOCUMENTS

| | | | | | |
|---|---|---|---|---|---|
| JP | 64-063675 | A | * | 9/1989 | ..... F04C 2/344 |
| JP | 3948104 | | | 7/2007 | |
| JP | 2008-248833 | | | 10/2008 | |
| JP | WO 2015166718 | A1 | * | 11/2015 | ..... F04C 15/06 |

* cited by examiner

FLUID PUMP HAVING A RETURN PASSAGE PARALLEL TO A SUCTION PASSAGE

TECHNICAL FIELD

The present invention relates to a fluid pump having a vane type rotor or a fluid pump having a trochoid type or inscribed gear (involute gear) type inner and outer rotors, and in particular, a fluid pump which sucks in and discharges oil (lubricating oil) of an internal combustion engine (i.e. an engine) or the like.

BACKGROUND ART

As a pump for sucking in and discharging fluid, there is known a vane pump which includes a housing having a suction port and a discharge port, a cam ring arranged in the housing and having a cam face at an inner circumferential face, a rotor arranged in the cam ring and driven rotationally, a shaft (a rotary shaft) rotatably supported on the housing so as to rotate the rotor, and a plurality of vanes arranged movably advance or retreat from an outer circumferential face of the rotor in a radial direction and coming into slide contact with the inner circumferential face (i.e. the cam face) of the cam ring, the housing being provided with a return channel (return passage) which returns a portion (divided flow) of working fluid discharged from the discharge port so as to flow together with sucked fluid sucked in from the suction port in a direction perpendicular to a flow direction of the sucked fluid (for example, see Patent Document 1).

In this vane pump, it is adopted that a piping system in which a flow control valve is arranged between a discharge side piping connected to the discharge port of the housing and a return piping connected to the return channel of the housing. When the rotor is rotated at high speed and the discharge flow rate becomes more than a predetermined rate, the flow control valve is opened and a portion of the working fluid flowing through the discharge side piping is divided to flow into the return piping side, and the working fluid divided into the return piping is flowed together with sucked fluid flowing in from the suction port, and then the fluid flowed together is led to a pump chamber through a suction channel.

However, in the vane pump and the piping system, because the sucked fluid flowing in from the suction port and the returned fluid flowing in from the return channel merge at right angles to each other, the flow of the sucked fluid flowing in from the suction port is obstructed, and there are risks causing a disorder of the flow (turbulence) and an increase of flow loss or the like and therefore lowering of the pump efficiency.

CITED DOCUMENT

Patent Document

Patent Document 1: Japanese Unexamined Patent Publication No. 2008-248833.

SUMMARY OF THE INVENTION

Problem to be Solved by the Invention

In view of the above-described problem, it is an object of the present invention to provide a fluid pump capable of improving the pump efficiency by suppressing or preventing a generation of cavitation and the like at high speed rotation while preventing a disorder of the flow, flow loss and the like, in a configuration provided with a return passage making a portion of discharge fluid return and flow together with sucked fluid, in particular, capable of narrowing and downsizing while ensuring a desired discharge performance in two-stage type fluid pump.

Means for Solving Problem

A fluid pump according to the present invention includes a housing which has a suction port sucking in fluid from an outside and a discharge port discharging the fluid to the outside, a rotary shaft which is rotatably supported with respect to the housing, and a pump unit which is contained in the housing and sucks in, pressurizes, and discharges the fluid with being rotationally driven by the rotary shaft. The housing includes a suction passage which conducts the fluid from the suction port to the pump unit, a discharge passage which conducts the fluid from the pump unit to the discharge port, a return passage which returns a portion of the fluid flowing through the discharge passage to an upstream side of the pump unit, and a control valve which is arranged on a middle of the return passage and controls a flow of the returned fluid. The return passage is formed so as to conduct the returned fluid in the same direction as a flow of a sucked fluid flowing through the suction passage to make the returned fluid flow together with the sucked fluid.

According to the configuration, when the control valve is opened under a predetermined condition and a portion (returned fluid) of the fluid pressurized by and discharged from the pump unit is returned to an upstream side of the pump unit though the return passage, the returned fluid is conducted in the same direction as the flow of sucked fluid sucked in from the suction port and flowing through the suction passage and merge with the sucked fluid. Therefore, a disorder of the flow, flow loss and the like which are caused when both flows (the flow of sucked oil and the flow of the returned oil) merge with each other can be suppressed. In particular, under a high speed rotation (a heavy load) in which a self-priming performance of the pump falls, a generation of cavitation can be suppressed or prevented, and a pump efficiency can be improved.

In the above configuration, it is possible to adopt a configuration that the fluid pump further includes a pipe-shaped member which defines the return passage, and the pipe-shaped member is formed so as to have a predetermined length extending parallel to an extension direction of the suction passage and is fixed to the housing.

According to the configuration, since the pipe-shaped member different from the housing is adopted, a moldability of the housing body upon molding can be enhanced, and the return passage can be easily arranged parallel to the suction passage even though the suction passage is relatively narrow.

In the above configuration, it is possible to adopt a configuration that the pump unit includes a first pump unit which is composed of a first inner rotor integrally rotated with the rotary shaft and a first outer rotor rotated while being interlocked with the first inner rotor and a second pump unit which is composed of a second inner rotor integrally rotated with the rotary shaft and a second outer rotor rotated while being interlocked with the second inner rotor, the suction passage and the return passage are formed so as to communicate with the first pump unit, and the discharge passage is formed so as to communicate with the second pump unit.

According to the configuration, the sucked fluid which is sucked in from the suction port through the suction passage (and the returned fluid which is returned through the return passage) can be pressurized and discharged from the discharge port to the outside and pressure-fed toward various areas via two-stage pressurization process by the first pump unit and the second pump unit.

In the above configuration, it is possible to adopt a configuration that the housing includes a rotor case which contains the first pump unit and the second pump unit, a housing body which have a concave portion into which the rotor case is fitted, and a housing cover which is connected to the housing body so as to close an opening of the housing body.

According to the configuration, the whole assembly can be easily achieved only by incorporating the first pump unit and the second pump unit (and the rotary shaft) into the rotor case, incorporating the rotor case including two pump units into the housing body and attaching the housing cover.

In the above configuration, it is possible to adopt a configuration that the housing cover has a concave portion by which the sucked fluid flowing through the suction passage and the returned fluid flowing through the return passage are merged with each other and is directed toward the first pump unit.

According to the configuration, an outlet of the suction passage and an outlet of the return passage are configured to open toward the concave portion which is formed on the inner wall of the housing cover, whereby the sucked fluid and the returned fluid can be merged with each other with a best condition less flow loss and conducted to the pump unit (e.g. the first pump unit).

In the above configuration, it is possible to adopt a configuration that the housing cover has an ejection port which is formed to face the first pump unit so as to eject air-mixed fluid with air being mixed.

According to the configuration, in a case that the fluid pump is, for example, adopted to an engine (in which the fluid pump functions so as to suck in and pressurize oil in the oil pan to feed), air-mixed oil (lubricating oil) sucked in through the suction port is ejected from the ejection port to the outside to be returned to the oil pan while being pressurized by the first pump unit. Therefore, oil (fluid) in which mixed air has been removed to the utmost can be pressurized and fed to the second pump unit, thereby improving the pump performance as a whole.

In the above configuration, it is possible to adopt a configuration that each of the first pump unit and the second pump unit is composed of an inner rotor and an outer rotor that form a trochoid type with four blades and five nodes.

According to the configuration, mixed air can be efficiently ejected, a desired high discharge flow amount can be ensured, and the pump performance and the durability can be improved.

Advantageous Effect of the Invention

According to a fluid pump having the above-mentioned structure, a generation of cavitation and the like at high speed rotation can be suppressed or prevented while preventing a disorder of the flow, flow loss and the like, whereby the pump efficiency can be improved. In particular, in two-stage type fluid pump, narrowing and downsizing thereof can be achieved while ensuring a desired discharge performance.

EMBODIMENT OF THE INVENTION

Figure 1:
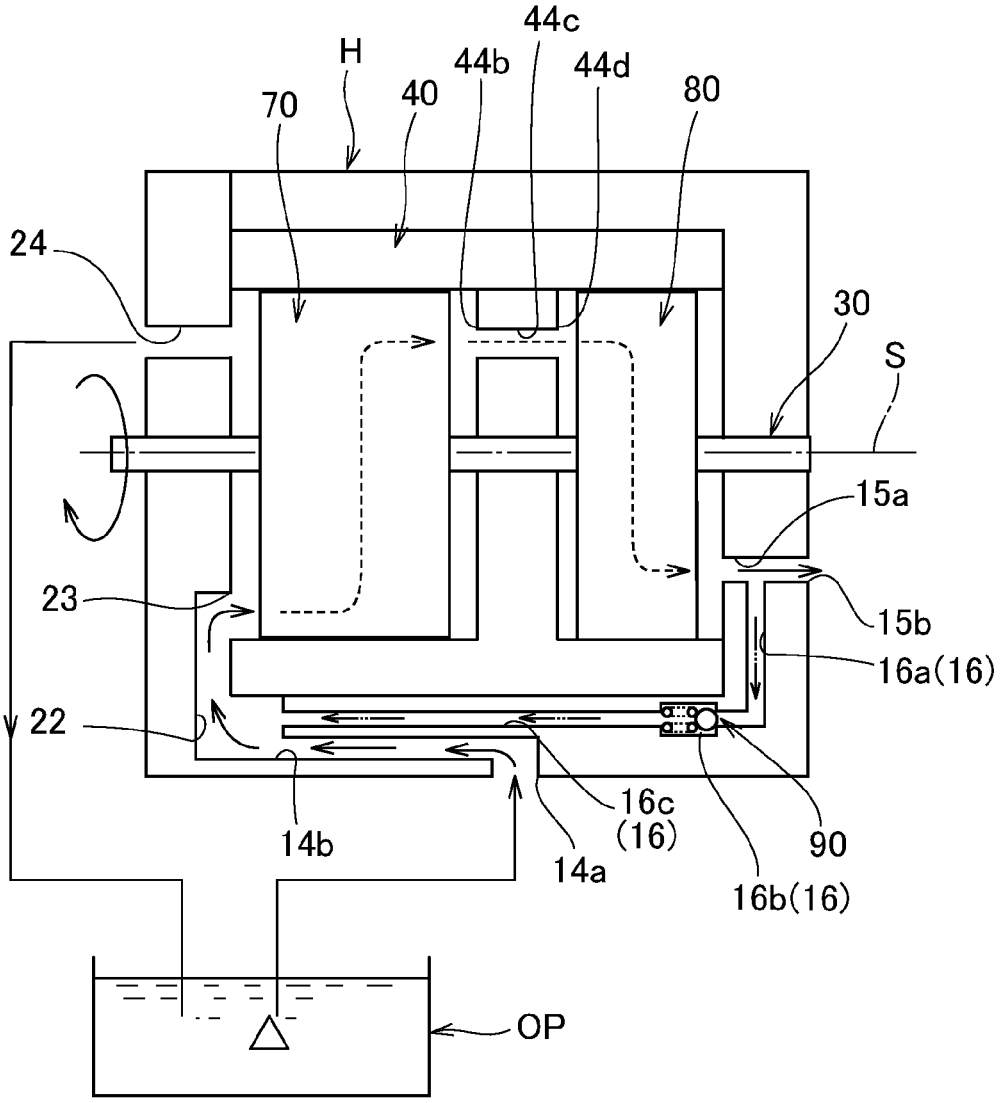
FIG. 1 is a schematic view of a fluid pump according to the present invention.

Hereinafter, embodiments of the present invention will be described with reference to the attached drawings.

A fluid pump according to an embodiment is an oil pump which is adopted to an internal combustion engine (i.e. an engine) and the like to suck in and discharge oil (lubricant oil) as fluid. As shown in FIGS. 1 to 6, the fluid pump includes a housing body 10 and a housing cover 20 which form a housing H, a rotary shaft 30 which is rotatably supported by the housing H about an axis line S, a rotor case 40 which is assembled in the housing H, a side plate 50 which comes into contact with an end face of the rotor case 40, an O-ring 60 which urges the side plate 50 toward the rotor case 40 in a direction of the axis line S, a first pump unit 70 (including a first inner rotor 71 and a first outer rotor 72) which is contained in the rotor case 40, a second pump unit 80 (including a second inner rotor 81 and a second outer rotor 82) which is contained in the rotor case 40 with being adjacent to the first pump unit 70 in the direction of the axis line S, a control valve 90 which controls a flow of oil (returned fluid) when returning a portion of oil discharged from the second pump unit 80 to an upstream side of the first pump unit 70, and the like.

Although the rotor case 40 and the sideplate 50 are formed as being separated from the housing H, those constitute a part of the housing H as being to contain the first pump unit 70 and the second pump unit 80.

The housing body 10 is made of aluminum material for weight reduction and the like and formed to define a concave portion for containing the first pump unit 70 and the second pump unit 80 together with the rotor case 40. As shown in FIG. 4, FIG. 6, FIG. 7 and FIG. 8, the housing body 10 includes a bearing hole 11 for rotatably supporting one end portion 31 of the rotary shaft 30 via a bearing G, a cylindrical inner circumferential face 12 into which the rotor case 40 is fitted, two circular end faces 13 which are formed around the bearing hole 11 and formed to lessen a diameter so as to define a stepped portion at a back side of the inner circumferential face 12, a positioning hole 13*a* which positions the side plate 50, a suction port 14*a* which is formed by removing and drilling apart of the outer wall outward in the radial direction and trough which oil is sucked, a suction passage 14*b* which crosses the suction port 14*a* at right angles to each other and extends in the direction of the axis line S, a discharge passage 15*a* which is formed at a back side and through which pressurized oil is discharged, a discharge port 15*b* which is located at an end of the discharge passage 15*a* and from which oil is discharged to the outside, a return passage 16 (16*a*, 16*b*, 16*c*) which diverges from a middle of the discharge passage 15*a* and through which a portion of pressurized oil is returned, a joint face 17 for joining the housing cover 20, screw holes 17*a* into which bolts B for fastening the housing cover 20 are screwed, positioning holes 17*b* for positioning the housing cover 20, a fitting hole 18 into which (a valve body 91 of) the control valve 90 is slidably fitted, and the like.

Figure 3:
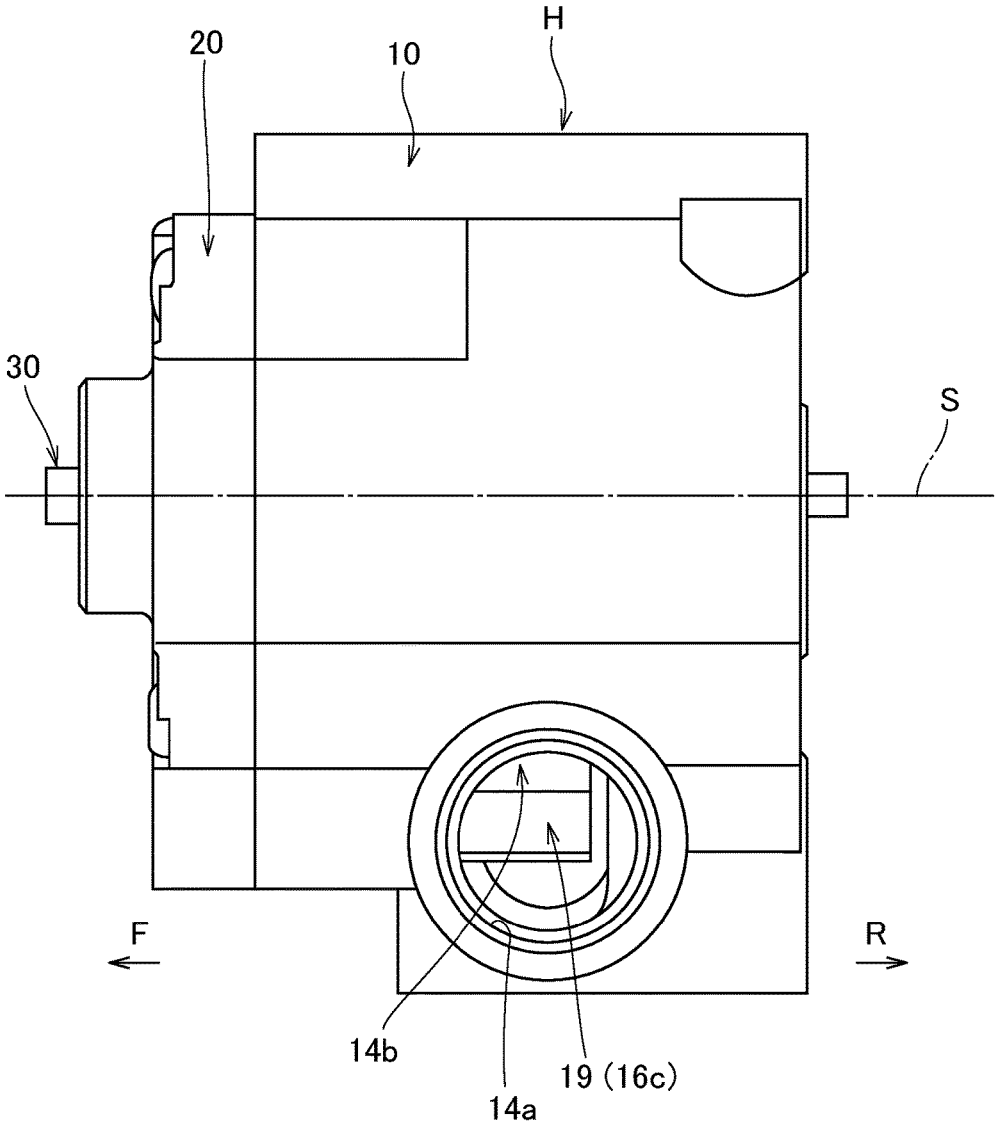
FIG. 3 is a side view of the fluid pump illustrated in FIG. 2.
Figure 4:
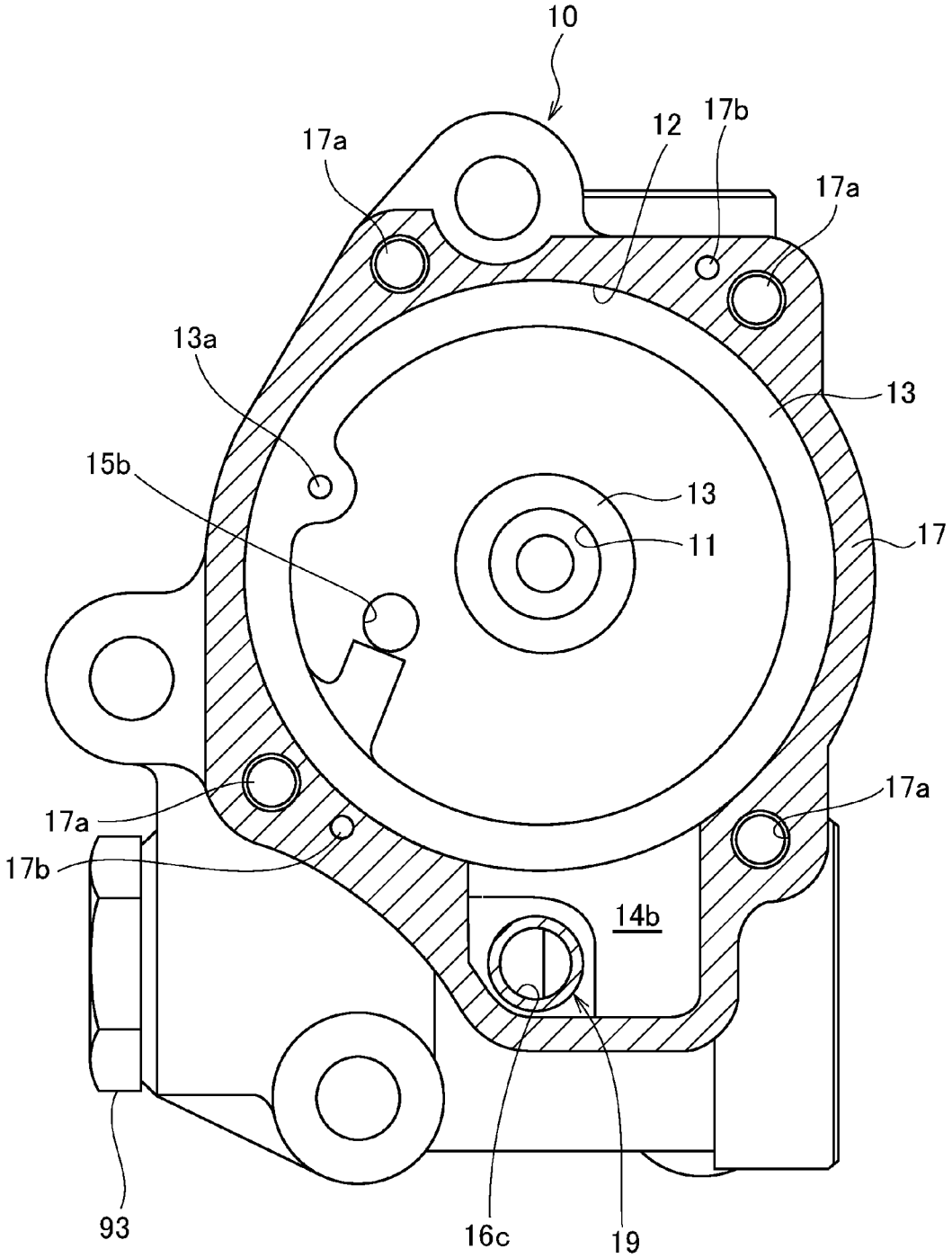
FIG. 4 is a front view illustrating a housing body forming a part of the fluid pump illustrated in FIG. 2.
Figure 5A:
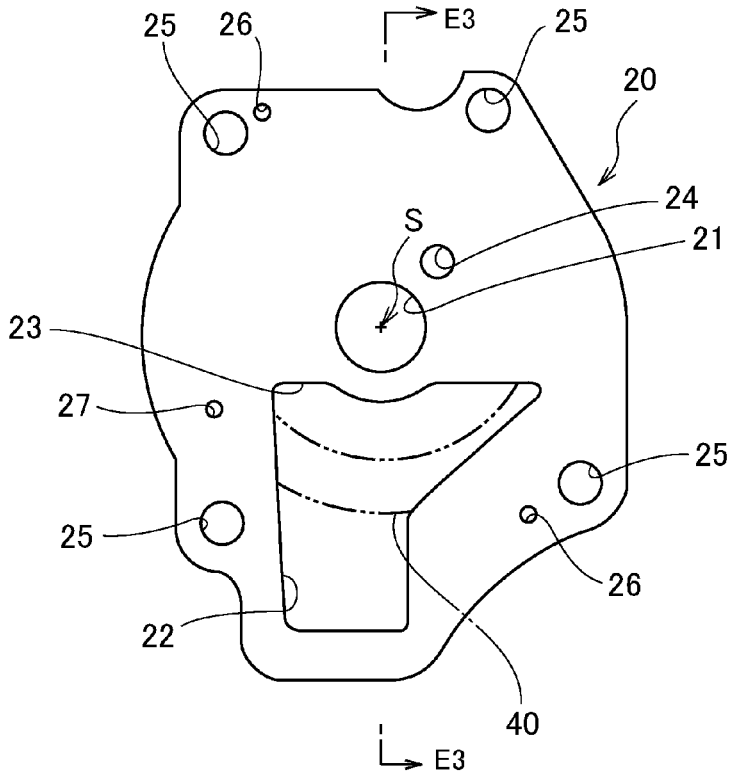
FIG. 5A is a rear view of a housing cover forming a part of the fluid pump illustrated in FIG. 2 viewed from the rear R side (inner surface side).
Figure 5B:
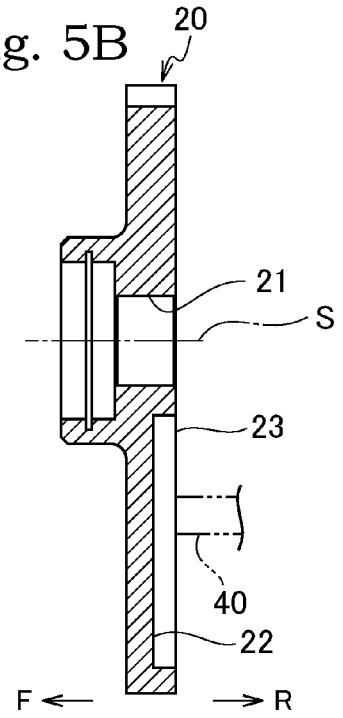
FIG. 5B is a sectional view of the housing cover forming a part of the fluid pump illustrated in FIG. 2 at E3-E3 in FIG. 5A.
Figure 8:
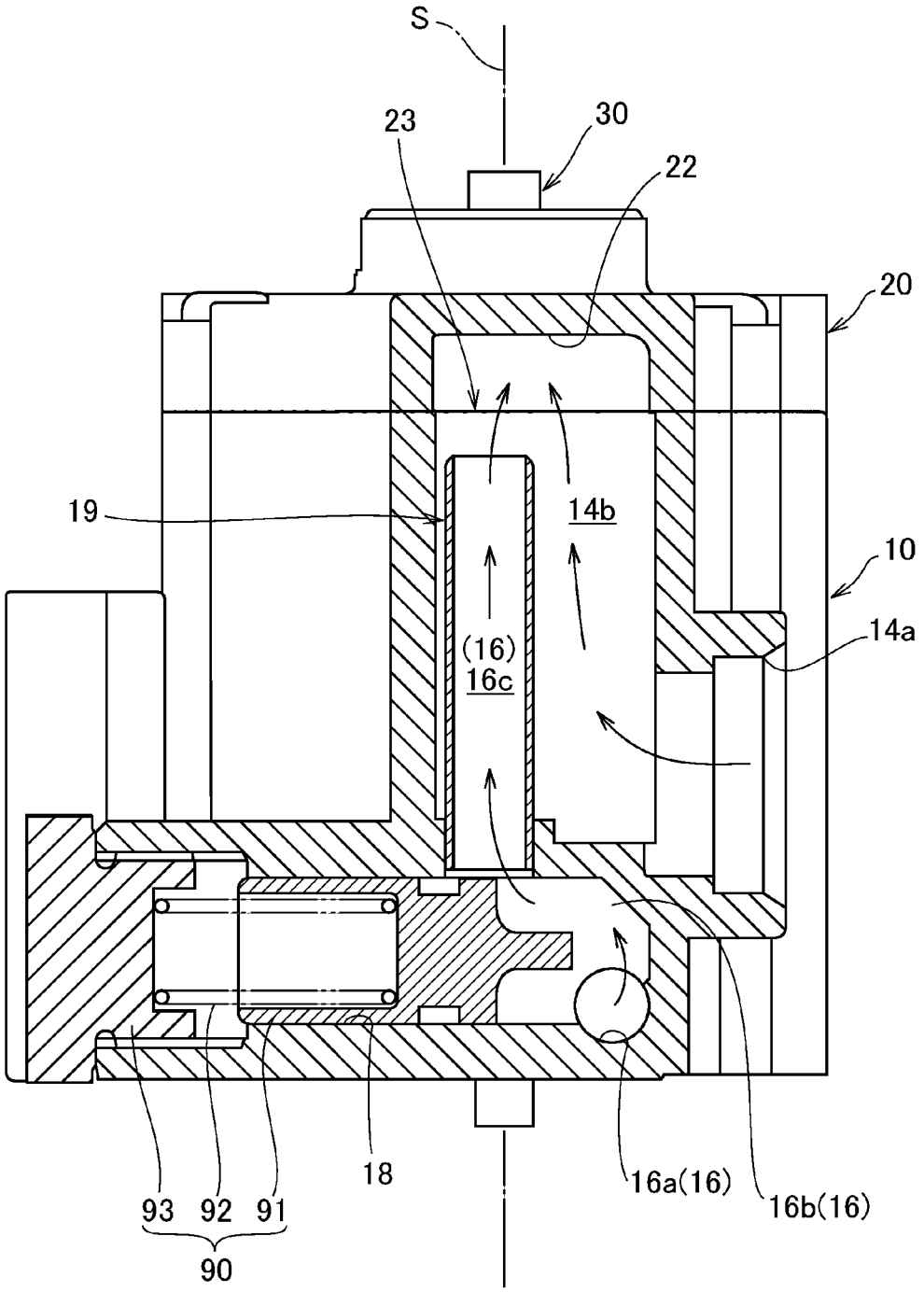
FIG. 8 is a sectional view of the interior (with a control valve opened) of the fluid pump illustrated in FIG. 2 at E2-E2 in FIG. 2.

The suction port 14*a* is, as shown in FIG. 3, FIG. 4, and FIG. 8, formed to open at the outer wall of the housing body 10, and formed so as to connect with a piping which leads oil from an outside oil pan OP.

Figure 6:
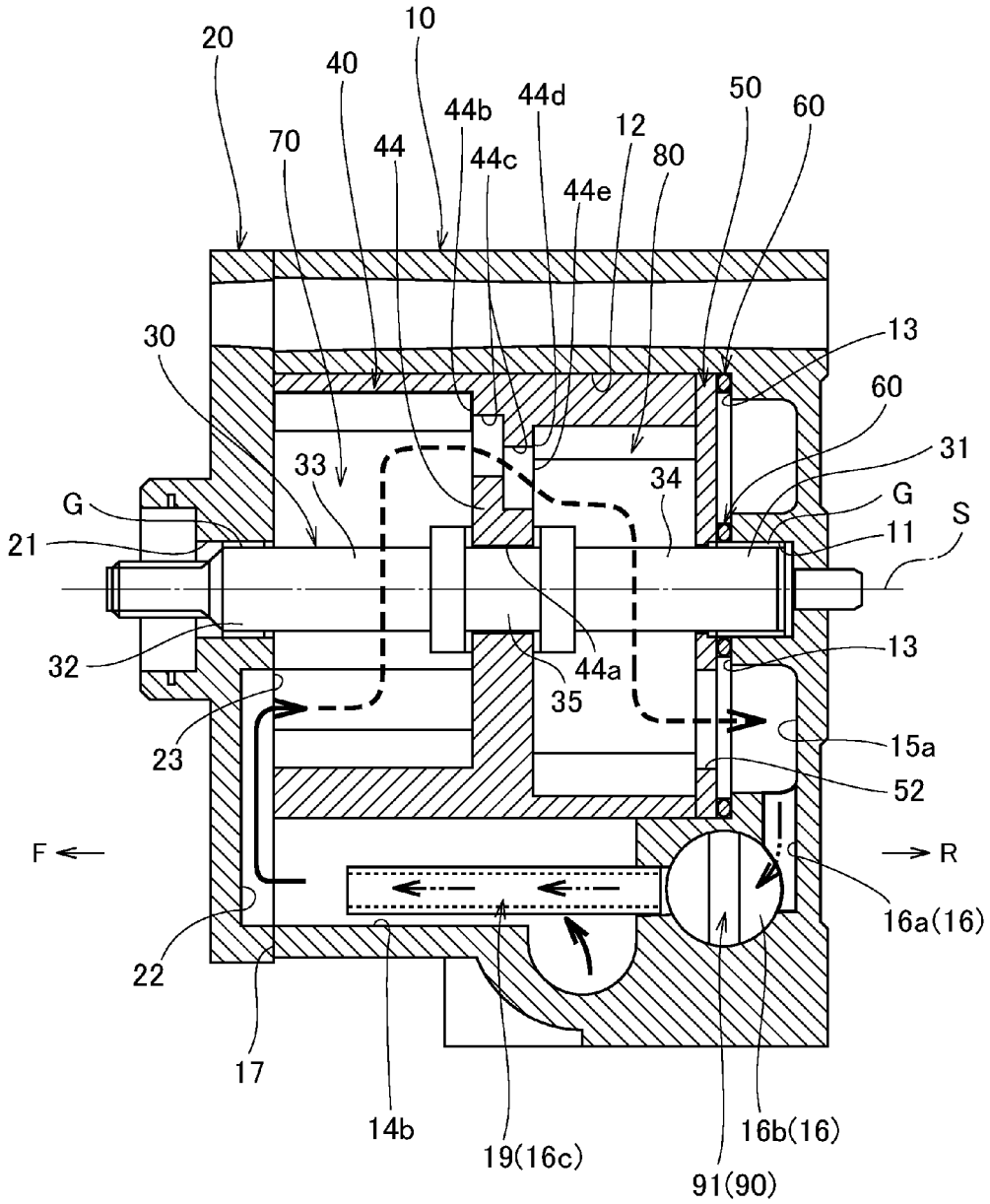
FIG. 6 is a sectional view of the interior of the fluid pump illustrated in FIG. 2 at E1-E1 in FIG. 2.

The suction passage 14*b* is, as shown in FIG. 1, FIG. 4, and FIG. 6, in order to lead oil sucked from the suction port 14*a* to a pump chamber inlet 23 in the upstream of the first pump unit 70, formed so as to extend in a direction perpendicular to an opening direction of the suction port 14*a*, namely, so as to extend parallel to the axis line S toward the front side from a middle of the housing H and open toward a concave portion 22 of the housing cover 20.

The discharge passage 15*a* is, as shown in FIG. 6, formed by removing a back wall of the housing body 10 into a concave and circular form around the rotary shaft 30 in order to lead oil discharged from the second pump unit 80 through a discharge port 52 of the side plate 50 toward the discharge port 15*b*.

The discharge port 15*b* is, as shown in FIG. 4, formed to open at the outer back wall of the housing body 10 and formed so as to connect with a piping which leads pressurized oil to outside lubrication areas and the like.

The return passage 16 is, as shown in FIG. 1, FIG. 6, FIG. 7, and FIG. 8, composed of a return passage 16*a* which communicates with the fitting hole 18 and the discharge passage 15*a*, a return passage 16*b* which is defined by the fitting hole 18 and a tip part of (the valve body 91 of) control valve 90, and a return passage 16*c* which is defined by a cylindrical pipe-shaped member 19 fitted and fixed to the housing body 10.

The return passage 16 (namely, the return passage 16*a*→the return passage 16*b*→the return passage 16*c*) is configured to make a portion (returned oil) of oil flowing through the discharge passage 15*a* flow together (or merge) with oil (sucked oil) flowing through the suction passage 14*b* in order to lead the portion (returned oil) to the pump chamber inlet 23 in the upstream of the first pump unit 70 when the control valve 90 is opened under a predetermined condition.

Figure 7:
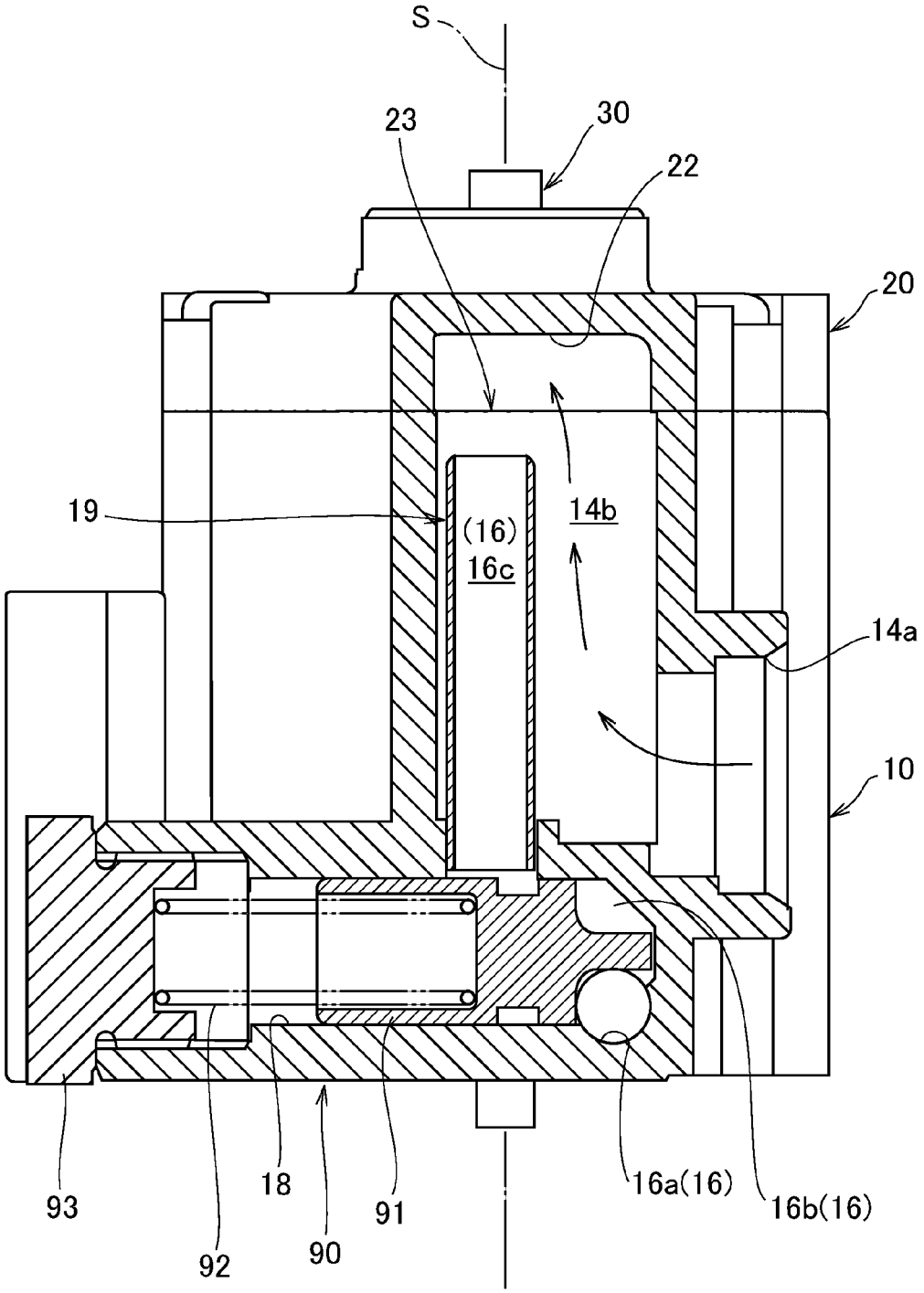
FIG. 7 is a sectional view of the interior (with a control valve closed) of the fluid pump illustrated in FIG. 2 at E2-E2 in FIG. 2.

Here, the pipe-shaped member 19 is, as shown in FIG. 6, FIG. 7, and FIG. 8, formed to extend so as to have a predetermined length in the direction of the axis line S and open toward the concave portion 22 of the housing cover 20.

That is, the return passage 16*c* defined by the pipe-shaped member 19 is, as shown in FIG. 6, FIG. 7, and FIG. 8, configured to conduct the returned oil (return fluid) in the same direction (the direction parallel to the axis line S and toward the front side F) as the flow of the oil (sucked oil) sucked from the suction port 14*a* and flowing through the suction passage 14*b* and make the returned oil flow together (or merge) with the oil (sucked oil).

Therefore, when the control valve 90 is opened under a predetermined condition and a portion of the oil (returned oil) pressurized by and discharged from the second pump unit 80 is returned to (the pump chamber inlet 23) the upstream of the first pump unit 70 through the return passage 16, the portion of the oil (returned oil) is conducted in the same direction as the oil (sucked oil) sucked from the suction port 14*a* and flowing through the suction passage 14*b* and flow together (or merge) with the oil (sucked oil). As a result, a disorder of the flow, flow loss and the like which are caused when both flows (the flow of sucked oil and the flow of the returned oil) merge with each other can be suppressed or prevented. In particular, under a high speed rotation (a heavy load) in which a self-priming performance of the pump falls, a generation of cavitation can be suppressed or prevented, and a pump efficiency can be improved.

Further, since the return passage 16 (16*a*, 16*b*, 16*c*) is formed in (the housing body 10 of) the housing H, simplification of the system can be performed as compared with the case formed by use of separate piping arranged outside the housing H.

Furthermore, in this embodiment, the return passage 16*c* is formed by the pipe-shaped member 19 different from the housing H (housing body 10), whereby a moldability of the housing body 10 upon molding can be enhanced, and the return passage 16*c* can be easily arranged parallel to the suction passage 14*b* even though the suction passage 14*b* is relatively narrow.

The housing cover 20 is made of aluminum material which is the same as that of the housing body 10 for weight reduction and the like. As shown in FIG. 2, FIG. 3, FIG. 5A, FIG. 5B, and FIG. 6, the housing cover 20 includes a bearing hole 21 for rotatably supporting another end portion 32 of the rotary shaft 30 via a bearing G, a concave portion 22 communicating with the suction passage 14*b*, a pump chamber inlet 23 defined by the concave portion 22 and a front end face of the rotor case 40, an ejection port 24 through which air mixed with sucked oil (air-mixed oil) is ejected, circular holes 25 through which bolts B pass, positioning holes 26 for positioning itself to the housing body 10, a positioning hole 27 for positioning the rotor case 40, and the like.

The housing cover 20 is joined to the joint face 17 so as to close an opening of the housing body 10 while fitting positioning pins fitted into the positioning holes 17*b* into the positioning holes 26 and fitting a positioning pin fitted into a positioning hole 45*a* of the rotor case 40 into the positioning hole 27, and then is connected to the housing body 10 by screwing the bolts B passed through the circular holes 25 from the outer side into the screw holes 17*a*.

Here, the concave portion 22 is formed to make the sucked oil flowing through the suction passage 14*b* and the returned oil flowing through the return passage 16*c* merge with each other and direct the merged flow toward (the pump chamber inlet 23 of) the first pump unit 70, for example, formed in the shape of an inner wall face which is curved at areas of corners.

Therefore, by suitably adjusting the shape of the concave portion 22, the sucked oil and the returned oil can be merged with each other with a best condition less flow loss and conducted to the first pump unit 70.

Figure 2:
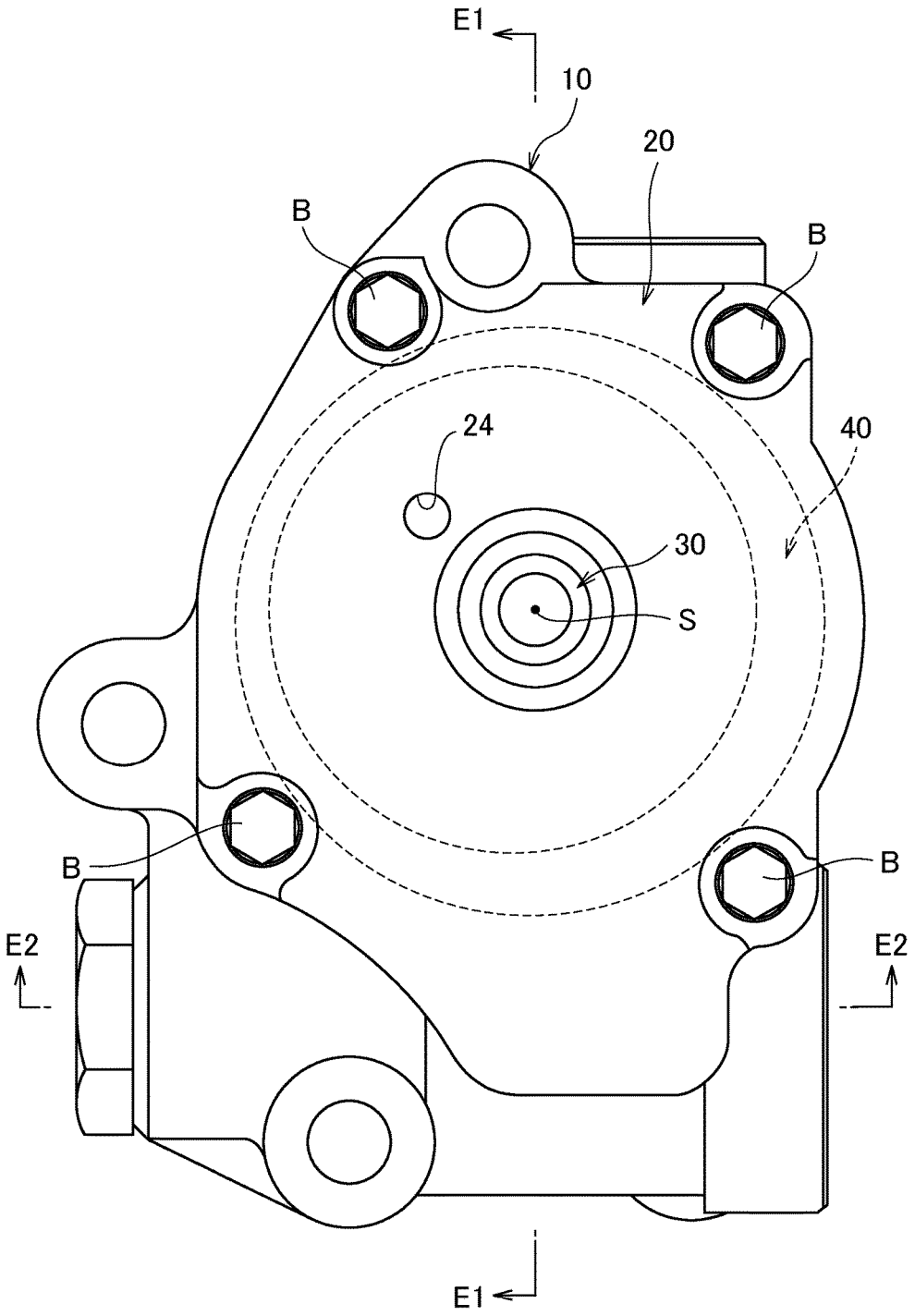
FIG. 2 is a front view illustrating an embodiment of a fluid pump according to the present invention.
Figure 12A:
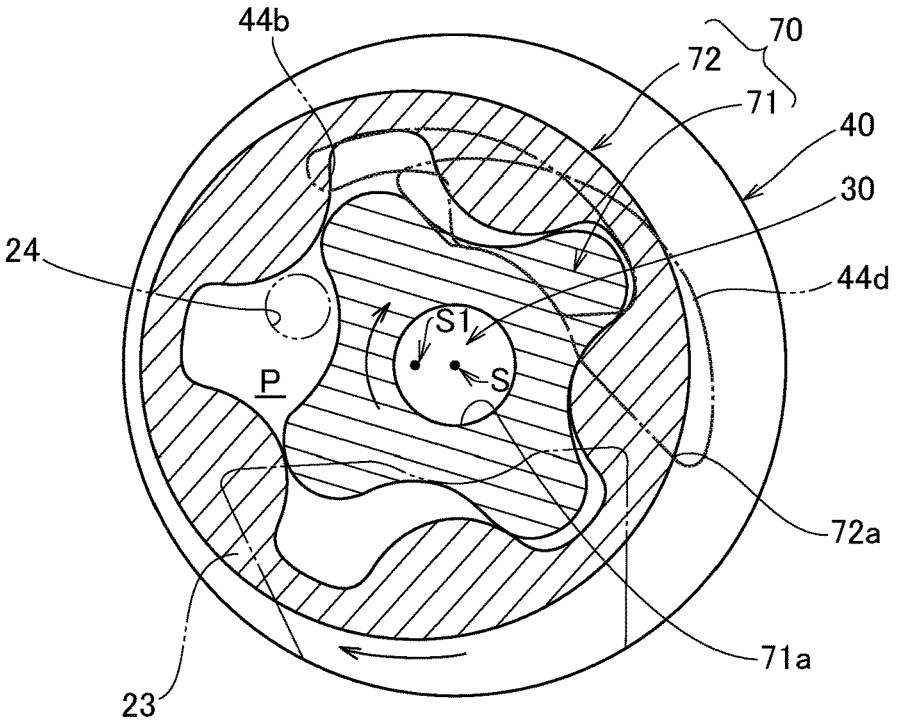
FIG. 12A is a sectional view illustrating the interior and a first pump unit (a first inner rotor and a first outer rotor) of the fluid pump illustrated FIG. 2 viewed from the front F side.

Further, the ejection port 24 is, as shown in FIG. 1, FIG. 2, and FIG. 12A, formed to face the first pump unit 70.

Here, since the ejection port 24 through which air-mixed oil is ejected is formed to face the first pump unit 70, a density (or mass) of air (or bubble) mixed with oil becomes small, namely, air can be easily concentrated inside of the pump chamber by the action of centrifugation and therefore, mixed air can be ejected efficiently.

The rotary shaft 30 is made of steel or the like and, as shown in FIG. 6, is formed so as to extend in the direction of the axis line S. The rotary shaft 30 includes one end portion 31 which is supported by the bearing hole 11 of the housing body 10 via the bearing G, another end portion 32 which is supported by the bearing hole 21 of the housing cover 20 via the bearing G, a shaft portion 33 which integrally rotates the first inner rotor 71 of the first pump unit 70, a shaft portion 34 which integrally rotates the second inner rotor 81 of the second pump unit 80, a shaft portion 35 which is supported by the bearing G, and the like. And, the rotary shaft 30 is configured to be rotationally driven with being connected to an outside rotary drive member or the like.

The rotor case 40 is made of steel, casting iron, sintered steel, or the like and, as shown in FIG. 6, FIG. 9, FIG. 10A, and FIG. 10B, includes a cylindrical portion 41 centered at the axis line S, an inner circumferential face 42 centered at a rotation center line L1 (of the first outer rotor 72) which is shifted by a predetermined amount from the axis line S at the inside of the cylindrical portion 41, an inner circumferential face 43 centered at a rotation center line L2 (of the second outer rotor 82) which is shifted by a predetermined amount from the axis line S at the inside of the cylindrical portion 41, a partition wall 44 formed between the inner circumferential face 42 and the inner circumferential face 43 in the direction of the axis line S, a bearing hole 44*a* provided on the partition wall 44, a middle discharge port 44*b*, a middle communication passage 44*c*, and a middle suction port 44*d* which are provided on the partition wall 44, an end face 45 with which the housing cover 20 is in contact, a positioning hole 45*a* formed at the end face 45, an end face 46 with which the side plate 50 comes into contact, a positioning hole 46*a* formed at the end face 46, and the like.

The cylindrical portion 41 is formed to have an outer diameter dimension so that the cylindrical portion 41 is fitted into the inner circumferential face 12 of the housing body 10 so as to relatively move in the direction of the axis line S in accordance with difference between thermal deformation (expansion and shrinkage) amounts of the housing body 10 and the rotor case 40 while being in compact contact with the inner circumferential face 12 of the housing body 10.

The inner circumferential face 42 is formed to have a dimension so that the first outer rotor 72 of the first pump unit 70 is in internal contact with the inner circumferential face 42 so as to rotate (or slide) about the rotation center line L1.

The inner circumferential face 43 is formed to have a dimension so that the second outer rotor 82 of the second pump unit 80 is in internal contact with the inner circumferential face 43 so as to rotate (or slide) about the rotation center line L2.

Figure 9:
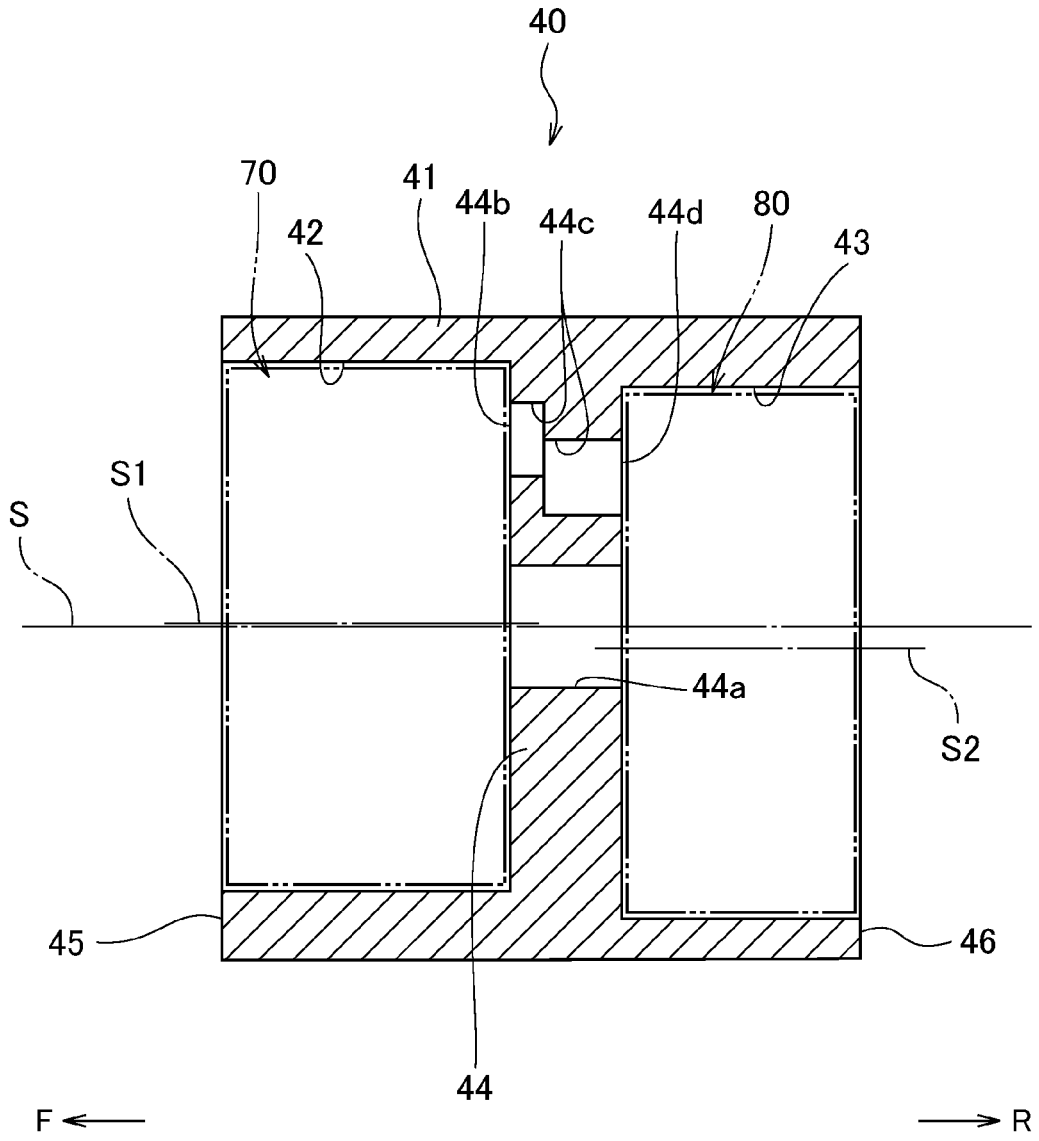
FIG. 9 is a sectional view illustrating a rotor case forming a part of the fluid pump illustrated in FIG. 2.
Figure 10A:
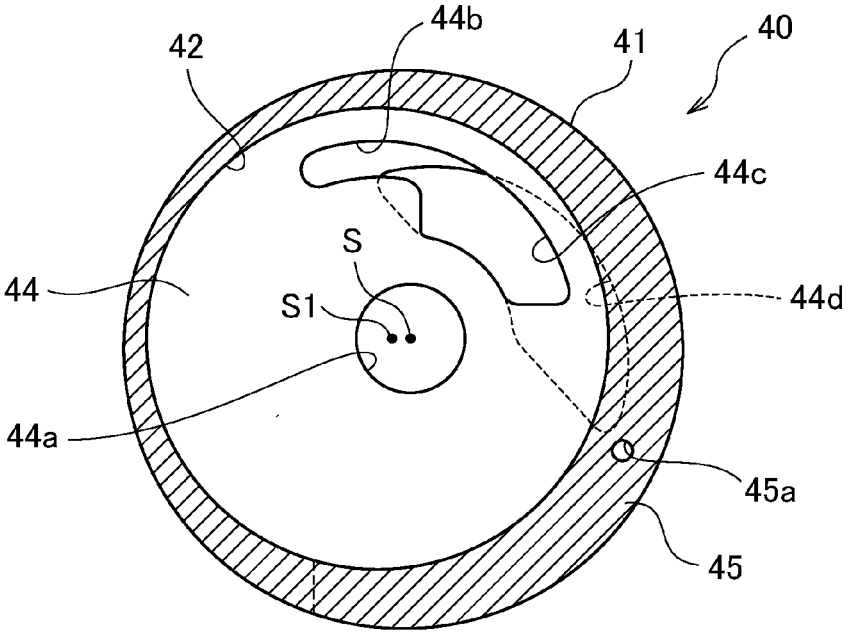
FIG. 10A is an end view of the rotor case illustrated in FIG. 9 viewed from the front F side.
Figure 10B:
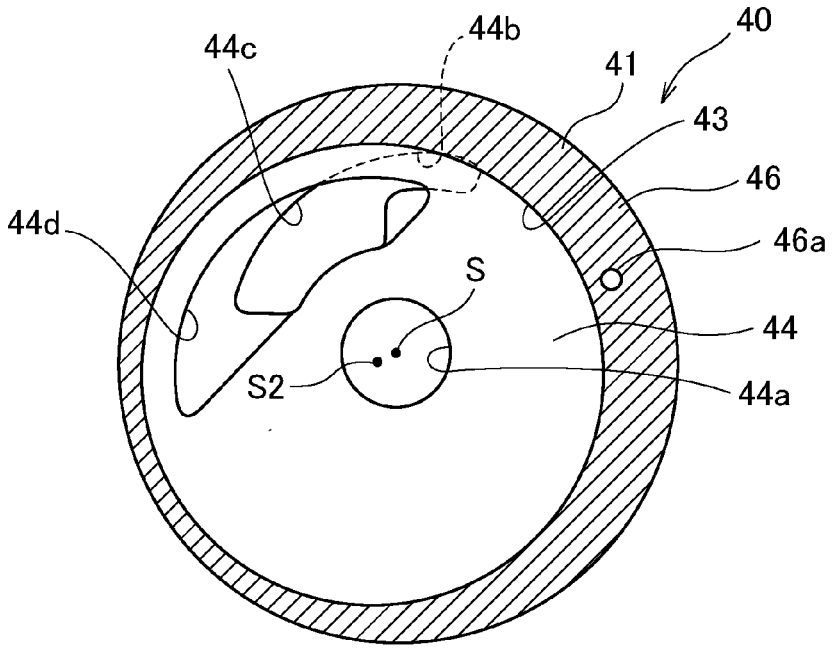
FIG. 10B is an end view of the rotor case illustrated in FIG. 9 viewed from the rear R side.

The partition wall 44 is, as shown in FIG. 6 and FIG. 9, to isolate the first pump unit 70 from the second pump unit 80, and formed in the shape of flat plate which has a predetermined thickness in the direction of the axis line S. One end face of the partition wall 44 is in slidable contact with the first pump unit 70, and another end face of the partition wall 44 is in slidable contact with the second pump unit 80.

The middle discharge port 44*b* is used for discharging oil pressurized by the first pump unit 70 and formed to open at the one end face of the partition wall 44.

The middle suction port 44*d* is used when the second pump unit 80 sucks in the oil pressurized by the first pump unit 70 and formed to open at the another end face of the partition wall 44.

The communication passage 44*c* is formed so as to conduct oil from the first pump unit 70 to the second pump unit 80 while having a required passage area between the middle discharge port 44*b* and the middle suction port 44*d*.

The rotor case 40 is, with containing the first pump unit 70 inside the inner circumferential face 42 and the second pump unit 80 inside the inner circumferential face 43 together with the rotary shaft 30, assembled (fitted) to the inner circumferential face 12 of the housing body 10 in such a manner that the positioning pin fitted into the positioning hole 13*a* is fitted into the positioning hole 46*a* while sandwiching the O-ring 60 and the side plate 50 in cooperation with the end face 13.

Figure 11A:
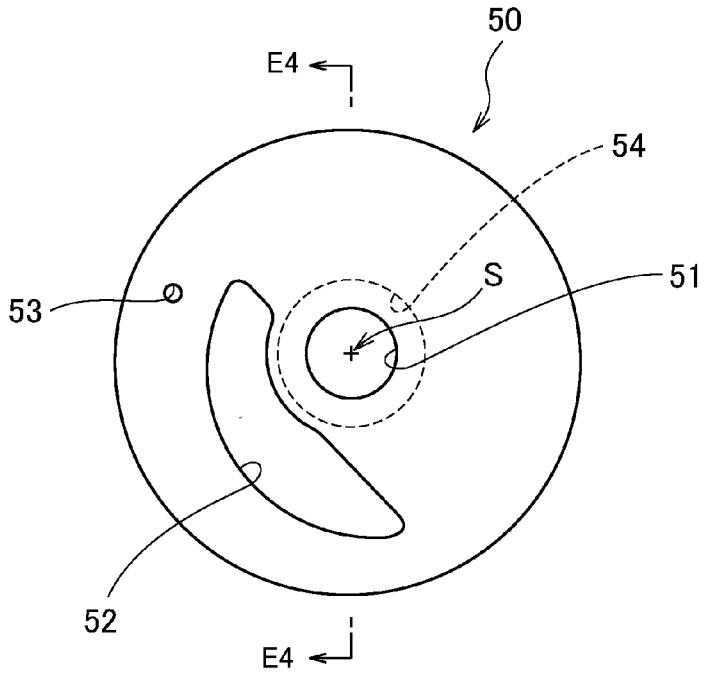
FIG. 11A is a front view of a side plate forming a part of the fluid pump illustrated in FIG. 2 viewed from the front F side.
Figure 11B:
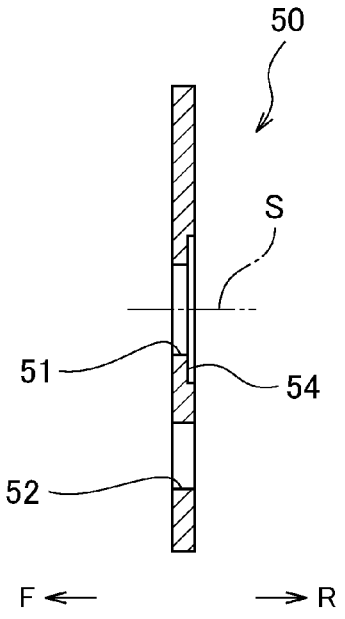
FIG. 11B is a sectional view of the side plate forming a part of the fluid pump illustrated in FIG. 2 at E4-E4 in FIG. 11A.

The side plate 50 is made of steel, casted iron, sintered steel, aluminum alloy, or the like and formed in the shape of disc. As shown in FIG. 6, FIG. 11A, and FIG. 11B, the side plate 50 includes a circular hole 51 through which the rotary shaft 30 passes, a discharge port 52 through which oil pressurized by the second pump unit 80 is discharged toward the discharge passage 15*a*, a positioning hole 53, a concave portion 54 which receives one end side of the bearing G, and the like.

The side plate 50 is assembled to the housing body 10 in such a manner that a positioning pin fitted into the positioning hole 13*a* of the housing body 10 is passed through the positioning hole 53 and the O-ring 60 is sandwiched between the side plate 50 and the end face 13.

The O-ring 60 is formed circularly with being made of elastically-deformable rubber material or the like and is arranged between the end face 13 of the housing body 10 and the side plate 50. The O-ring 60 is assembled with being compressed by a predetermined compression amount in the direction of the axis line S so as to urge the side plate 50 toward the end face 46 of the rotor case 40.

The first pump unit 70 is made of steel, sintered steel, or the like, and as shown in FIG. 12A, is composed of the first inner rotor 71 which is rotated together with the rotary shaft 30 about the axis line S and the first outer rotor 72 which is rotated about the rotation center line S1 arranged at the position shifted by a predetermined amount from the axis line S, namely, configured as a trochoid pump having four blades and five nodes.

The first inner rotor 71 is formed as an external gear which has a fitting hole 71*a* into which the shaft portion 33 of the rotary shaft 30 is fitted, and four crests and roots (recessions) at a periphery thereof.

The first outer rotor 72 is formed as an internal gear which has an outer circumferential face 72*a* slidably fitted to the inner circumferential face 42 of the rotor case 40, and five crests (inner teeth) and roots (recessions) to be engaged with the four crests (external teeth) and roots (recessions) of the first inner rotor 71 at an inner circumference thereof.

In this configuration, when the first inner rotor 71 is rotated together with the rotary shaft 30 in an arrow direction (clockwise direction in FIG. 12A) about the axis line S, the first outer rotor 72 is rotated while being interlocked with the first inner rotor 71 in the arrow direction (clockwise direction in FIG. 12A) about the rotation center line S1. As a result, the volume of the pump chamber P defined by both rotors is varied, and the oil is sucked through the pump chamber inlet 23 and pressurized subsequently. And, in the pressurization process, air-mixed oil is ejected through the ejection port 24, and subsequently the remaining oil is discharged from the middle discharge port 44*b* toward the second pump unit 80. The above processes are to be repeated continuously.

Figure 12B:
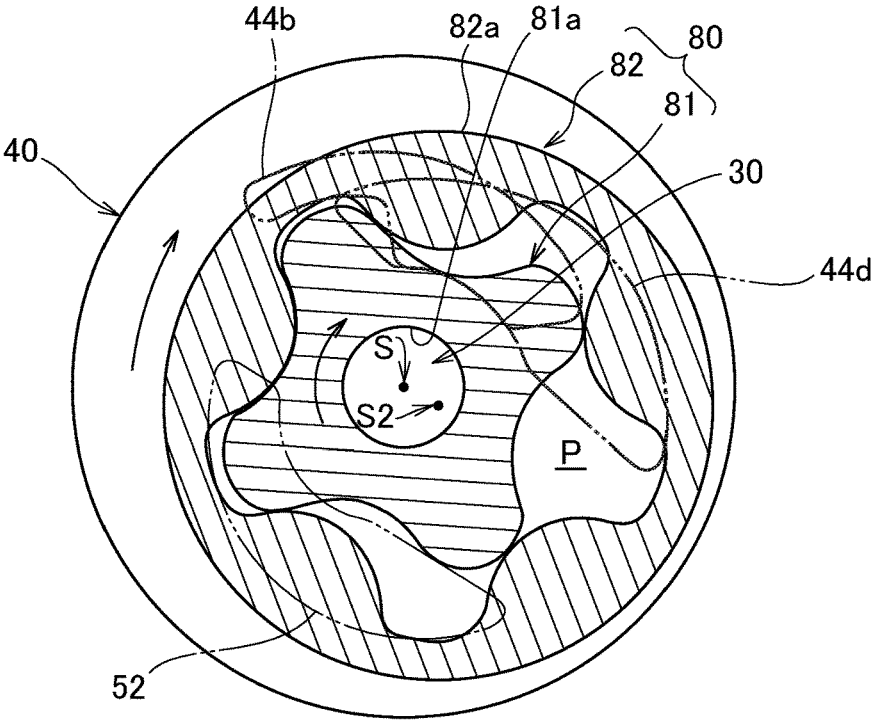
FIG. 12B is a sectional view illustrating the interior and a second pump unit (a second inner rotor and a second outer rotor) of the fluid pump illustrated FIG. 2 viewed from the front F side.

The second pump unit 80 is made of steel, sintered steel, or the like, and as shown in FIG. 12B, is composed of the second inner rotor 81 which is rotated together with the rotary shaft 30 about the axis line S and the second outer rotor 82 which is rotated about the rotation center line S2 arranged at the position shifted by a predetermined amount from the axis line S, namely, configured as a trochoid pump having four blades and five nodes.

The second inner rotor 81 is formed as an external gear which has a fitting hole 81*a* into which the shaft portion 34 of the rotary shaft 30 is fitted, and four crests and roots (recessions) at a periphery thereof.

The second outer rotor 82 is formed as an internal gear which has an outer circumferential face 82*a* slidably fitted to the inner circumferential face 43 of the rotor case 40, and five crests (inner teeth) and roots (recessions) to be engaged with the four crests (external teeth) and roots (recessions) of the second inner rotor 81 at an inner circumference thereof.

In this configuration, when the second inner rotor 81 is rotated together with the rotary shaft 30 in an arrow direction (clockwise direction in FIG. 12B) about the axis line S, the second outer rotor 82 is rotated while being interlocked with the second inner rotor 81 in the arrow direction (clockwise direction in FIG. 12B) about the rotation center line S2. As a result, the volume of the pump chamber P defined by both rotors is varied, and the oil is sucked through the middle suction port 44*d* and pressurized, subsequently the oil is discharged from the discharge port 52 through the discharge passage 15*a* and the discharge port 15*b* toward an external lubrication area. The above processes are to be repeated continuously.

Upon assembling of the oil pump having the above-mentioned configuration, since the housing H is composed of the housing body 10 and the housing cover 20, and the configuration that the first pump unit 70 and the second pump unit 80 are separated from each other in advance and contained inside the rotor case 40 defining the partition wall 44 is adopted, it is possible to easily assemble in such a manner that the first pump unit 70 and the second pump unit 80 together with the rotary shaft 30 are arranged in the rotor case 40, subsequently, the O-ring 60, the side plate 50, and the rotor case 40 are sequentially contained in the housing body 10, and finally the housing cover 20 is attached from above.

The control valve 90 is, as shown in FIG. 7 and FIG. 8, composed of a valve body 81 which is slidably inserted into the fitting hole 18 of the housing body 10, an urging spring 92 for urging the valve body 91 in a direction making the valve body 91 close, and a screw cap 93 by which the urging spring 92 is shutted and compressed by a predetermined amount of compression.

The control valve 90 is to operate such a manner that when the discharge flow amount of oil discharged from the second pump unit 80 becomes a predetermined discharge flow amount, the valve body 91 opens the return passage 16*b* while opposing an urging force of the urging spring 92 and becomes a valve-opened state, and makes a portion of discharged oil flowing through the discharge passage 15*a* as returned oil flow out to the return passage 16*c*. While, the discharge flow amount lowers less than a predetermined discharge flow amount, the valve body 91 is closed by the urging force of the urging spring 92 and stops the return of oil.

Here, the control valve 90 is contained in the housing body 10. Therefore, simplification of the system can be accomplished as compared with the case arranged outside the housing H.

Next, operation of the oil pump will be described with reference to FIG. 7, FIG. 8, FIG. 12A and FIG. 12B.

First, the rotary shaft 30 is rotationally driven and the first pump unit 70 (composed of the first inner rotor 71 and the first outer rotor 72) is rotated in the clockwise direction in FIG. 12A, whereby in the state that the control valve 90 closes as shown in FIG. 7, oil supplied from the outside is sucked in the pump chamber P of the first pump unit 70 via the suction port 14*a*→the suction passage 14*b*→the concave portion 22→the pump chamber inlet 23.

And, oil sucked in pump chamber P is pressurized by continuous rotation of the first pump unit 70. In the pressurization process, air-mixed oil is actively ejected outside as a predetermined ejection amount through the ejection port 24, and subsequently the remaining oil is pressurized up to a predetermined discharge pressure and discharged (supplied) toward the second pump unit 80 through the middle discharge port 44*b*→the communication passage 44*c*→the middle suction port 44*d*.

Subsequently, the second pump unit 80 (composed of the second inner rotor 81 and the second outer rotor 82) is rotated in the clockwise direction in FIG. 12B, and oil is sucked in the pump chamber P of the second pump unit 80 via the middle suction port 44*d*.

And, oil sucked in pump chamber P is pressurized by continuous rotation of the second pump unit 80 and pressurized up to a predetermined discharge pressure and discharged (supplied) in a predetermined discharge amount toward an external lubrication area through the discharge port 52→the discharge passage 15*a*→the discharge port 15*b*.

When the rotary shaft 30 is rotated at a high speed and the discharge flow amount from the second pump unit 80 becomes a predetermined level, the control valve 90 opens as shown in FIG. 8, and a portion (returned oil) of oil flowing through the discharge passage 15*a* is returned to the upstream side (the pump chamber inlet 23) of the first pump unit 70 through the return passage 16 (16*a*, 16*b*, 16*c*).

Here, the returned oil flowing through the return passage 16*c* is conducted in the same direction as the sucked oil sucked from the suction port 14*a* and flowing through the suction passage 14*b* and flow together (or merge) with the sucked oil). As a result, a disorder of the flow, flow loss and the like which are caused when both flows (the flow of sucked oil and the flow of the returned oil) merge with each other can be suppressed. In particular, under a high speed rotation (a heavy load) in which a self-priming performance of the pump falls, a generation of cavitation can be suppressed or prevented, and the pump efficiency can be improved.

Practically, cooperative action of the first pump unit 70 (composed of the first inner rotor 71 and the first outer rotor 72) and the second pump unit 80 (composed of the second inner rotor 81 and the second outer rotor 82) performs a series of processes, such as suction of oil from the oil pan at a first stage→pressurization of oil at the first stage→ejection of mixed air and oil (air-mixed oil) at the first stage→discharge of remained oil to the downstream side at the first stage (suction of oil at a second stage)→pressurization of oil at the second stage→discharge of oil at the second stage (when rotating at high speed, additionally return of oil though the return passage 16).

In the above-mentioned embodiment, the present invention is applied to the structure in which the rotor case 40, the side plate 50, and the like as a second housing are arranged at the inside of the housing (the housing body 10 and the housing cover 20). However, not limited to the above, the present invention may be applied to a structure disusing the rotor case 40, the side plate 50, and the like.

In the above-mentioned embodiment, the present invention is applied to the two-stage trochoid pump which includes the first pump unit 70 (composed of the first inner rotor 71 and the first outer rotor 72) and the second pump unit 80 (composed of the second inner rotor 81 and the second outer rotor 82). However, not limited to the above, the present invention may be applied to a structure having an inscribed gear (involute gear) type inner rotor and outer rotor, a structure having vane type pump unit, or a fluid pump dealing with fluid other than oil.

In the above-mentioned embodiment, the present invention is applied to the structure in which the housing is separated into the housing body and the housing cover. However, not limited to the above, the present invention may be applied to a structure in which a dual partitioning housing includes a first housing half body and a second housing half body which define a concave portion, respectively.

In the above-mentioned embodiment, the oil pump of the present invention is applied to an engine mounted on an automobile and the like. However, not limited to the above, the present invention may be applied to a continuously variable transmission (CVT) and the like other than an engine.

INDUSTRIAL APPLICABILITY

As mentioned above, according to the fluid pump of the present invention, it is possible to improve the pump efficiency by suppressing or preventing a generation of cavitation and the like at high speed rotation while preventing a disorder of the flow, flow loss and the like. In particular, in two-stage type fluid pump, narrowing and downsizing thereof can be accomplished. Accordingly, in addition to be naturally adopted to an engine which is mounted on an automobile or the like, the fluid pump of the present invention is useful for motorcycles, other vehicles with an engine mounted, continuously variable transmissions (CVT) or other mechanisms which need a pressure fee of lubricating oil.

EXPLANATION OF REFERENCES

H housing
10 housing body (housing)
11 bearing hole
12 inner circumferential face
13 end face
14*a* suction port
14*b* suction passage
15*a* discharge passage
15*b* discharge port
16 (16*a*, 16*b*, 16*c*) return passage
17 joint face
18 fitting hole
19 pipe-shaped member
20 housing cover (housing)
21 bearing hole
22 concave portion
23 pump chamber inlet
24 ejection port
30 rotary shaft
S axis line
40 rotor case
41 cylindrical portion
42 inner circumferential face
43 inner circumferential face
44 partition wall
44*a* bearing hole
44*b* middle discharge port
44*c* communication passage
44*d* middle suction port
50 side plate
51 circular hole
52 discharge port
60 O-ring
70 first pump unit
P pump chamber
71 first inner rotor
71*a* fitting hole
72 first outer rotor
S1 rotation center line
72*a* outer circumferential face
80 second pump unit
81 second inner rotor
81*a* fitting hole
82 second outer rotor
S2 rotation center line
82*a* outer circumferential face
90 control valve
91 valve body
92 urging spring
93 screw cap

The invention claimed is:

1. A fluid pump, comprising:

a rotary shaft;

a pump unit for sucking in, pressurizing, and discharging fluid with being rotationally driven by the rotary shaft;

a housing rotatably supporting the rotary shaft and containing the pump unit, the housing having a suction port to suck in the fluid from outside, a discharge port to discharge the fluid to the outside, a suction passage crossing the suction port to extend in a predetermined direction and conducting the fluid from the suction port to the pump unit, a discharge passage conducting the fluid from the pump unit to the discharge port, and a first part of a return passage returning a portion of the fluid flowing through the discharge passage to an upstream side of the pump unit;

a control valve arranged at the return passage and controlling a flow of a returned fluid, by the return passage; and a pipe-shaped member fixed to the housing and defining a second part of the return passage that communicates with the first part of the return passage formed by the housing, the pipe-shaped member being parallel to the suction passage, extending within the suction passage, and opening into the suction passage at downstream side of the suction passage with respect to an area where the suction passage crosses the suction port.

2. The fluid pump according to claim 1, wherein the housing comprises a housing body having an opening in a direction of an axis line of the rotary shaft, and a housing cover connected to the housing body that closes the opening of the housing body, the suction passage is formed so as to extend parallel to the direction of the axis line, and the pipe-shaped member is formed so as to extend parallel to the direction of the axis line, inserted from a side of the opening of the housing body and fitted to the housing body.

3. The fluid pump according to claim 1, wherein the pump unit includes a first pump unit comprising a first inner rotor integrally rotated with the rotary shaft and a first outer rotor rotated while being interlocked with the first inner rotor, and a second pump unit comprising a second inner rotor integrally rotated with the rotary shaft and a second outer rotor rotated while being interlocked with the second inner rotor, the suction passage and the return passage are formed so as to communicate with the first pump unit, and the discharge passage is formed so as to communicate with the second pump unit.

4. The fluid pump according to claim 3, wherein the housing includes a rotor case containing the first pump unit and the second pump unit, a housing body having a concave portion into which the rotor case is fitted, and a housing cover connected to the housing body so as to close an opening of the housing body.

5. The fluid pump according to claim 4, wherein the housing cover has a concave portion by which the sucked fluid flowing through the suction passage and the returned fluid flowing through the return passage are merged with each other and directed toward the first pump unit.

6. The fluid pump according to claim 4, wherein the housing cover has an ejection port formed to face the first pump unit so as to eject air-mixed fluid.

7. The fluid pump according to claim 3, wherein each of the first pump unit and the second pump unit comprises an inner rotor and an outer rotor that form a trochoid gear with four blades and five nodes.

8. The fluid pump according to claim 1, wherein the control valve is arranged at a middle of the return passage.

* * * * *